US010283915B2

(12) United States Patent
Han et al.

(10) Patent No.: US 10,283,915 B2
(45) Date of Patent: May 7, 2019

(54) CONNECTOR AND ELECTRONIC DEVICE INCLUDING THE SAME

(71) Applicant: Samsung Electronics Co., Ltd., Gyeonggi-do (KR)

(72) Inventors: Jae Ryong Han, Gyeonggi-do (KR); Kyu Hyuck Kwak, Gyeonggi-do (KR); Eun Seok Hong, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/149,873

(22) Filed: May 9, 2016

(65) Prior Publication Data

US 2016/0329663 A1 Nov. 10, 2016

(30) Foreign Application Priority Data

May 7, 2015 (KR) ..... 10-2015-0064075
May 7, 2015 (KR) ..... 10-2015-0064076

(51) Int. Cl.
*H01R 13/648* (2006.01)
*H01R 13/6595* (2011.01)
*H01R 13/6593* (2011.01)

(52) U.S. Cl.
CPC ..... *H01R 13/6595* (2013.01); *H01R 13/6593* (2013.01)

(58) Field of Classification Search
CPC ..... H01R 13/65802; H01R 13/658; H01R 13/506; H01R 23/6873; H01R 23/7073
USPC ..... 439/607.27, 607.36, 607.37, 607.4, 439/607.55
See application file for complete search history.

(56) References Cited

U.S. PATENT DOCUMENTS 3,825,878 A * 7/1974 Finger ..... H01R 12/62 439/493
5,733,153 A * 3/1998 Takahashi ..... H01R 4/34 439/801
6,368,155 B1 * 4/2002 Bassler ..... H01R 13/6616 340/650
7,140,899 B2 * 11/2006 Matsunaga ..... H01R 12/83 439/326
7,771,235 B2 * 8/2010 Kameyama ..... H01R 13/648 439/607.27
7,906,957 B2 * 3/2011 Tarchinski ..... H01R 13/6273 324/149
8,052,467 B1 * 11/2011 Xie ..... H01R 13/5219 439/589
8,109,791 B2 * 2/2012 Kameyama ..... H01R 23/6873 439/607.37
8,568,170 B2 10/2013 Lan et al.
8,642,900 B2 2/2014 Nordling et al.
9,011,178 B2 * 4/2015 Hori ..... H01R 13/6581 29/842
9,093,797 B2 * 7/2015 Zhao ..... H01R 12/707
9,231,356 B1 * 1/2016 Ju ..... H01R 24/78
(Continued)

FOREIGN PATENT DOCUMENTS

KR 101324656 11/2013

*Primary Examiner* — Hien D Vu
(74) *Attorney, Agent, or Firm* — The Farrell Law Firm, P.C.

(57) ABSTRACT

Disclosed is a connector that interrupts electromagnetic waves and includes a terminal part, an inner shell surrounding the terminal part and having a plug form that is inserted into the connector from outside of the connector, and an outer shell surrounding at least a portion of the inner shell.

17 Claims, 13 Drawing Sheets

(56) References Cited

U.S. PATENT DOCUMENTS

| | | | | |
|---|---|---|---|---|
| 9,343,843 | B2 * | 5/2016 | Guo | H01R 13/5216 |
| 9,401,567 | B2 * | 7/2016 | Miyoshi | H01R 13/6581 |
| 9,444,919 | B2 * | 9/2016 | Bae | H04M 1/0249 |
| 9,843,142 | B2 * | 12/2017 | Hack | H01R 13/6583 |
| 2011/0088940 | A1 | 4/2011 | Nordling et al. | |
| 2013/0210274 | A1 | 8/2013 | Lan et al. | |
| 2015/0044894 | A1 | 2/2015 | Chen et al. | |
| 2015/0079847 | A1 * | 3/2015 | Liu | H01R 12/721 439/630 |
| 2016/0254588 | A1 * | 9/2016 | Kim | H01Q 1/24 343/702 |

* cited by examiner

CONNECTOR AND ELECTRONIC DEVICE INCLUDING THE SAME

PRIORITY

This application claims priority under 35 U.S.C. § 119(a) to Korean Patent Applications filed in the Korean Intellectual Property Office on May 7, 2015 and assigned Serial Numbers 10-2015-0064075 and 10-2015-0064076, the contents of both of which are incorporated herein by reference.

BACKGROUND

1. Field of the Disclosure

The present disclosure relates generally to a connector that transmits and receives data and an electronic device including the same.

2. Description of the Related Art

An electronic device such as a smartphone or a tablet includes a connector, such as a universal serial bus (USB) terminal, for transmitting and receiving data to and from an external device. The connector has a plug form, and includes terminals corresponding to the terminals of the plug. The terminals of the connector transmit and receive designated electrical signals.

A plurality of components that perform various functions is mounted in a limited mounting space in such an electronic device. In this case, interference is generated between adjacent components, and degrades specific performance of the electronic device.

In the connector mounted on the electronic device, electromagnetic waves generated as data is transmitted and received through the connector, and degrade the performances of the components, such as an antenna for wireless communication, disposed around the connector. For example, when data communication is performed through a connector that supports the USB 3.0 or 3.1 Standard, the radiation performance of the wireless communication antenna disposed around the connector decreases.

In another example, when data communication by the USB 3.0 or 3.1 Standard is performed while the connector is not separately shielded, the radiation performance of the wireless antenna decreases by the electromagnetic waves generated by the connector. In a data communication standard, including the USB Standards, through which data communication is performed at a high speed, the radiation performance also decreases by the electromagnetic waves generated due to data communication.

Since the connector according to the related art is not shielded and cannot efficiently interrupt electromagnetic waves even if it were shielded, the radiation performance of the antenna decreases.

As such, there is a need in the art for a connector that efficiently interrupts electromagnetic waves, and improves radiation performance in the electronic device.

SUMMARY

The present disclosure has been made to address at least the above-mentioned problems and/or disadvantages and to provide at least the advantages described below.

Accordingly, an aspect of the present disclosure is to provide a connector that interrupts electromagnetic waves in two stages by using an inner shell and an outer shell and minimizes an influence of electromagnetic waves on a peripheral wireless antenna, for example.

In accordance with an aspect of the present disclosure, there is provided a connector which includes a terminal part, an inner shell surrounding the terminal part and having a plug form inserted from the outside, and an outer shell surrounding at least a portion of the inner shell.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION OF EMBODIMENTS OF THE DISCLOSURE

Figure 1:
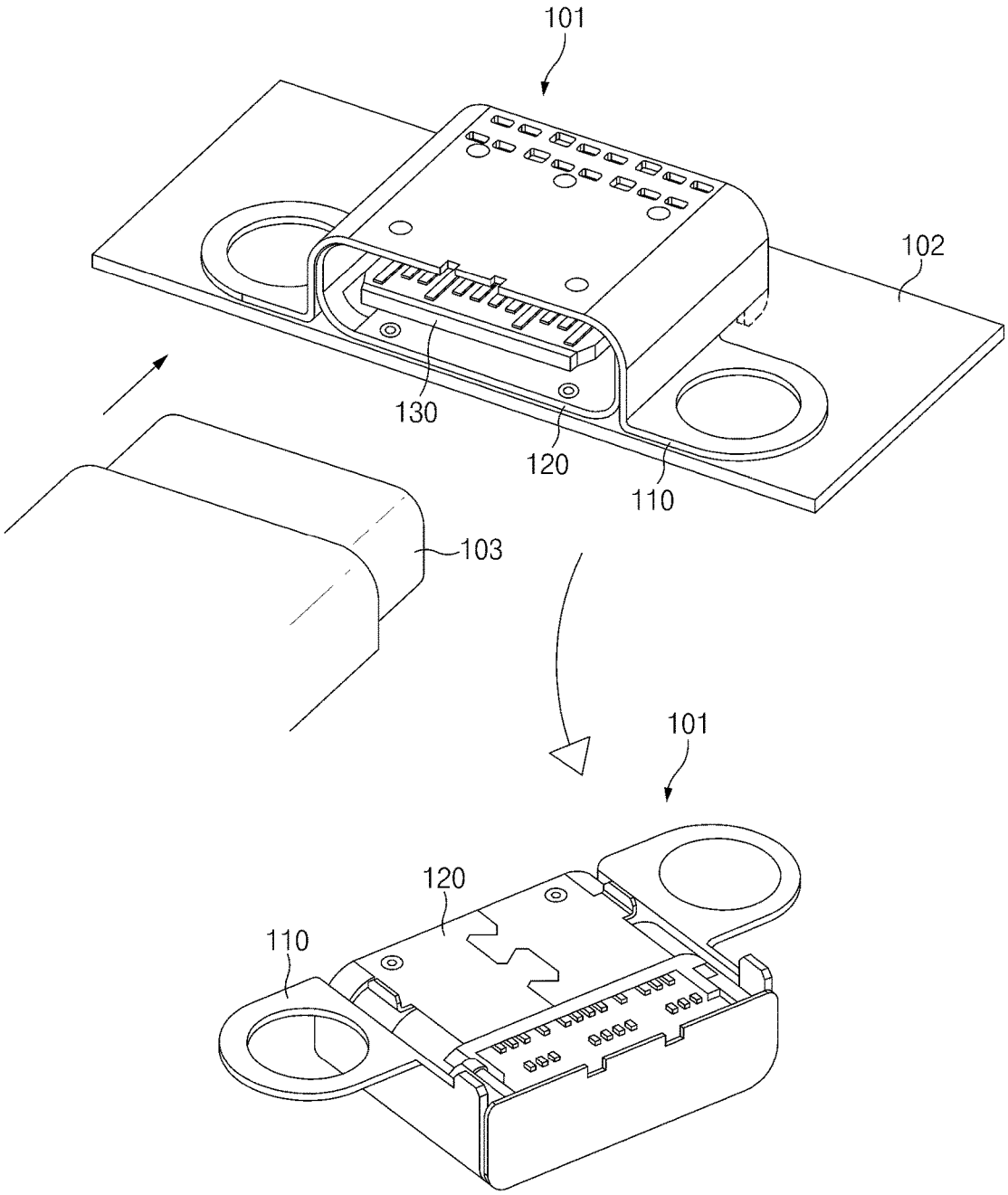
FIG. 1 is a perspective view of a connector according to embodiments of the present disclosure.

Hereinafter, embodiments of the present disclosure will be described with reference to the accompanying drawings. Accordingly, those of ordinary skill in the art will recognize that modifications, equivalents, and/or alternatives of the embodiments described herein can be variously made without departing from the scope and spirit of the present disclosure. With regard to description of drawings, similar components may be marked by similar reference numerals. A detailed description of known configurations and/or functions will be omitted for the sake of clarity and conciseness.

Herein, the expressions "have", "may have", "include" and "comprise", "may include" and "may comprise" indicate existence of corresponding numeric values, functions, operations, or components, but do not exclude presence of additional features.

The expressions "A or B", "at least one of A or/and B", and "one or more of A or/and B" may include any and all combinations of one or more of the associated listed items. For example, the expressions "A or B", "at least one of A and B", and "at least one of A or B" may refer to any of (1) when at least one A is included, (2) when at least one B is included, and (3) when both of at least one A and at least one B are included.

The terms "first" and "second" used herein may refer to various elements of embodiments of the present disclosure, but do not limit the elements. For example, such terms do not limit the order and/or priority of the elements, and may be used to distinguish one element from another element. For example, a first user device and a second user device may represent different user devices irrespective of sequence or importance, a first element may be referred to as a second element, and similarly, a second element may be referred to as a first element.

When an element, such as a first element, is referred to as being "(operatively or communicatively) coupled with/to" or "connected to" another element, such as a second element, the first element can be directly coupled with/to or connected to the second element or an intervening element, such as a third element, may be present. In contrast, when the first element is referred to as being "directly coupled with/to" or "directly connected to" the second element, it should be understood that there is no intervening third element.

According to the situation, the expression "configured to" used herein may be used as, for example, the expression "suitable for", "having the capacity to", "designed to", "adapted to", "made to", or "capable of". The expression "configured to" does not indicate only "specifically designed to" in hardware. Instead, the expression "a device configured to" indicates that the device is "capable of" operating together with another device or other components. A "processor configured to perform A, B, and C" indicates an embedded processor for performing a corresponding operation or a generic-purpose processor, such as a central processing unit (CPU) or an application processor, which performs corresponding operations by executing one or more software programs which are stored in a memory device.

Terms in this specification are used to describe specified embodiments of the present disclosure and are not intended to limit the scope of the present disclosure. The terms of a singular form include plural forms unless otherwise specified. Unless otherwise defined herein, all the terms used herein, which include technical or scientific terms, have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in embodiments of the present disclosure. In some cases, even if terms are terms which are defined in the specification, the terms may not be interpreted to exclude embodiments of the present disclosure.

Hereinafter, a connector mounted on an electronic device according to embodiments will be described with reference to the accompanying drawings. The term "user" used herein may refer to a person who uses an electronic device or an artificial intelligence electronic device that uses an electronic device.

FIG. 1 is a perspective view of a connector according to embodiments of the present disclosure.

Referring to FIG. 1, the connector 101 includes an outer shell 110, an inner shell 120, and a terminal part 130.

The connector 101 is mounted on a PCB 102, has a plug form 103 that is inserted into the connector 101 from the outside, and is electrically connected to the plug 103. In embodiments, the connector 101 may be a USB connector. In this case, the connector 101 includes a plurality of terminals for data communication according to the USB 3.1 Standard. Unlike in the existing USB 1.0 or 2.0 Standard, an operation frequency of the USB 3.1 Standard is similar or identical to a communication frequency of an antenna for wireless data communication. In this case, the outer shell 110 and the inner shell 120 prevent deterioration of antenna radiation performance by interrupting electromagnetic waves generated by a plurality of terminals.

Although the connector 101 supporting the USB 3.1 Standard will be mainly described, but the present disclosure is not limited thereto.

Hereinafter, 1) a surface of the connector 101 that contacts the PCB 102 will be referred to as a bottom surface, 2) a surface of the connector 101 that is parallel to the bottom surface but does not contact the PCB 102 will be referred to as a top surface, 3) a surface of the connector 101 into which the plug 103 is inserted will be referred to as a front surface, 4) a surface of the connector 101 that is parallel to the front surface and into which the plug 103 is not inserted will be referred to as a rear surface, and 5) surfaces of the connector 101 that are perpendicular to the bottom surface (or the top surface) and the front surface (or the rear surface) will be referred to as left and right side surfaces.

The outer shell 110 surrounds the outside of the connector 101, is formed of a metallic material, and interrupts electromagnetic waves irradiated to the outside of the inner shell 120. The outer shell 110 surrounds the top surface, the left and right surfaces, and the rear surface of the inner shell 120, except for the front surface into which the plug 103 is inserted, and is fixed to the PCB 102.

The connector according to the related art has no outer shell 110 that improves performance, and therefore cannot efficiently interrupt electromagnetic waves generated by the connector. Thus, the connector of the related art incurs deteriorating antenna radiation performance because the outer shell is mounted for the purpose of reinforcing strength. In contrast, the connector 101 according to the present disclosure efficiently interrupts electromagnetic waves through the outer shell 110 and the inner shell 120, and minimizes an influence of electromagnetic waves on an antenna for wireless communication. The inner shell 120 surrounds and protects the terminal part 130, is formed of a metallic material, interrupts electromagnetic waves generated due to data communication through the terminal part 130, and is electrically connected to a ground terminal of the PCB 102. When the inner shell 120 is connected to the ground terminal, external noise is interrupted and an electromagnetic wave shielding function is reinforced.

The inner shell 120 has a shape corresponding to the plug 103, and fixes the plug 103 to prevent the plug 103 from being separated during data communication.

The terminal part 130 includes a plurality of terminals which transmit and receive designated electrical signals. For example, when the connector 101 is a type C connector that supports the USB 3.1 Standard, the terminal part 130 includes twelve terminals disposed at an upper end of a mid-plate and twelve terminals disposed at a lower end of a mid-plate. The plurality of terminals extends towards the rear surface and the bottom surface of the connector 101 and is connected at designated locations of the PCB 102, such as by soldering.

The bottom surface of the inner shell 120, the fixing part of the outer shell 110, and pins that will be connected to the terminal part 130 are disposed on the bottom surface of the connector 101, which is fixed onto a surface of the PCB 102 through soldering and is connected to the PCB 102.

The plug 103 has a form corresponding to the inner shell 120 and includes terminals corresponding to the terminals of the terminal part 130, respectively. When the plug 103 is inserted into the inner shell 120, the corresponding terminals are electrically connected to each other to transmit and receive data. In embodiments, the plug 103 supports data communication according to the USB 3.1 Standard.

Figure 2:
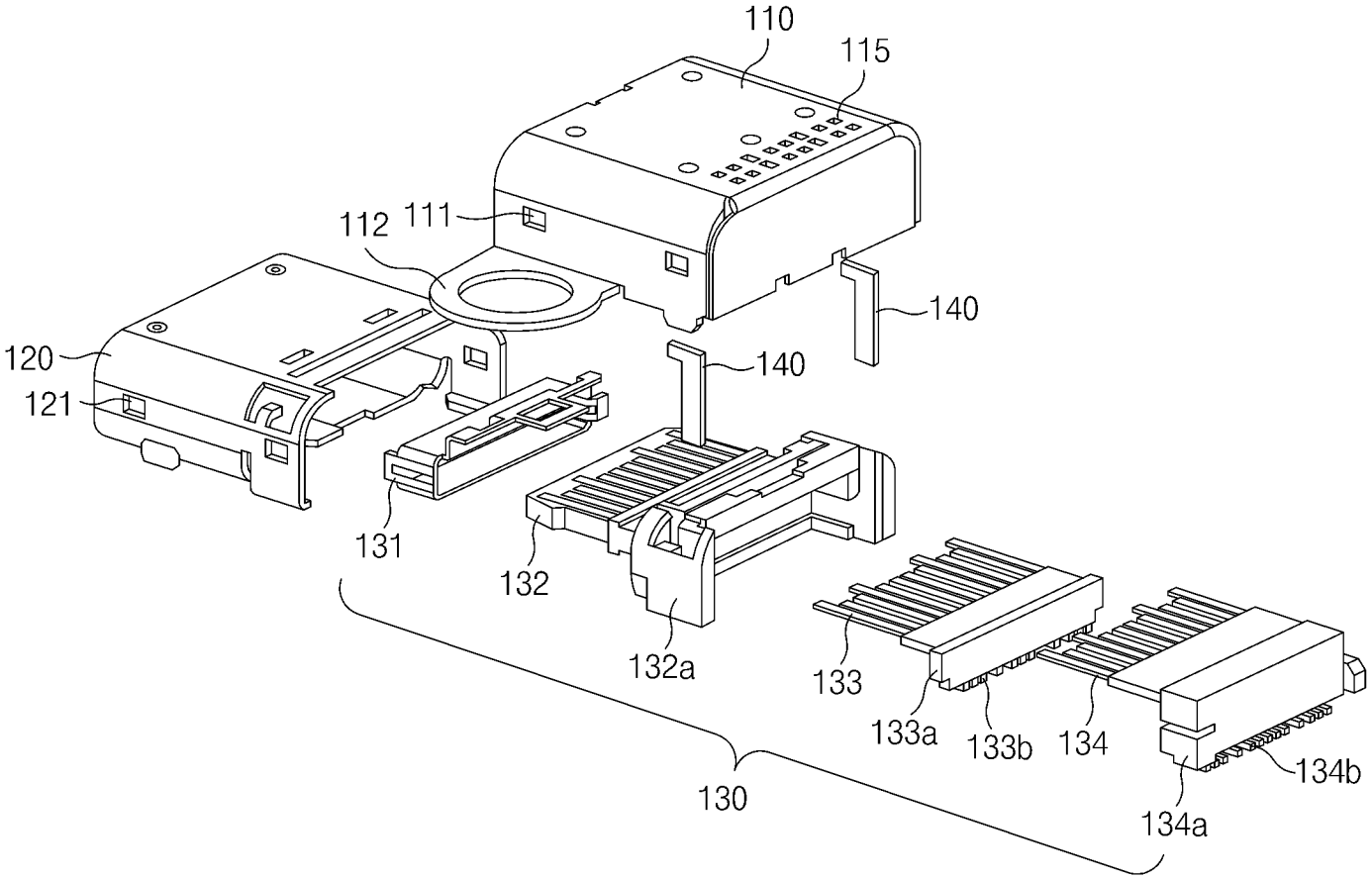
FIG. 2 is an exploded perspective view of a connector according to embodiments of the present disclosure.

FIG. 2 is an exploded perspective view of a connector according to embodiments of the present disclosure.

Referring to FIG. 2, the connector 101 includes an outer shell 110, an inner shell 120, a terminal part 130, and fixing axes 140. The terminal part 130 includes an electromagnetic compatibility (EMC) pad 131, a support 132, a first row of terminals 133, and a second row of terminals 134.

The outer shell 110 covers the top surface, the left and right side surfaces, and the rear surface of the inner shell 110. The front surface of the outer shell 110, through which the plug 103 is inserted, and the bottom surface of the outer shell 110, which is coupled to the PCB 102, are open. The outer shell 110 is integrally formed by cutting and forming a material, such as a metal panel.

The outer shell 110 includes coupling parts 111 that are coupled the inner shell 120 on the left and right side surfaces. The coupling parts 111 are coupled to, and have shapes corresponding to shapes of the coupling parts 121 of the inner shell 120.

The outer shell 110 further includes a fixing part 112 that is fixed to the PCB 102, has a hole at the center thereof, and is coupled to the PCB 102 through fixing screws or soldering.

The outer shell 110 includes at least one hole 115 that connects the inside and the outside of the connector 101. The hole 115 is used to apply a resin to designated pins for preventing corrosion due to moisture: from the outside, or to inspect pins in the interior of the connector 101 by the naked eye. Detailed description of the hole 115 is provided with reference to FIGS. 3 and 7.

The inner shell 120 is disposed in the interior of the outer shell 110. The top surface, left and right side surfaces, and rear surface of the inner shell 120 are attached and coupled to the outer shell 110. The front surface of the inner shell 120 is opened for inserting the plug 103, and the bottom surface of the inner shell 120 is fixed to the PCB 102. The inner shell 120 has a form corresponding to the plug 103, and fixes the plug 103 after the plug 103 is inserted. The inner shell 120 primarily interrupts electromagnetic waves generated due to data communication through the terminal part 130, and the outer shell 110 secondarily interrupts the electromagnetic waves, as will be discussed below.

The terminal part 130 includes an EMC pad 131, a support 132, a first row of terminals 133, and a second row of terminals 134.

The EMC pad 131 is a conductive pad, such as a metal pad, and shields electromagnetic waves radiated from the plurality of terminals or electromagnetic waves introduced from the outside.

The support 132 supports the first row of terminals 133 and the second row of terminals 134, includes a mid-plate at the center thereof, and includes an insulation member that surrounds the mid-plate. The support 132 is coupled to the EMC pad 131 and the inner shell 120 through the fixing part 132*a*.

The first row of terminals 133 and the second row of terminals 134 include a plurality of terminals corresponding to the plug 103. The first row of terminals 133 are upper terminals that support the USB 3.1 Standard, and the second row of terminals 134 are lower terminals that support the USB 3.1 Standard. The first row of terminals 133 and the second row of terminals 134 are arranged to be symmetrical to each other, and support the USB C-type. The first row of terminals 133 are coupled to the support 132 through the fixing part 133*a*, and the second row of terminals 134 are coupled to the support 132 through the fixing part 134*a*.

The first row of terminals 133 and the second row of terminals 134 are configured such that pins that are connected to the terminals are disposed to face the rear surface of bottom surface of the connector 101 through the fixing parts 133*a* and 134*b*. The first row of terminals 133 is connected to the pins 133*b* through the fixing part 133*a*, and the second row of terminals 134 is connected to the pins 134*b* through the fixing part 134*a*. The rear surface of the outer shell 110 includes an opening for preventing electrical influence with the pins 133*b* or 134*b*. A detailed description of the opening is provided with reference to FIG. 5.

The fixing axes 140 are disposed between the inner shell 120 and the terminal part 130. The fixing axes 140 fix the inner shell 120 to the terminal part 130.

Figure 3:
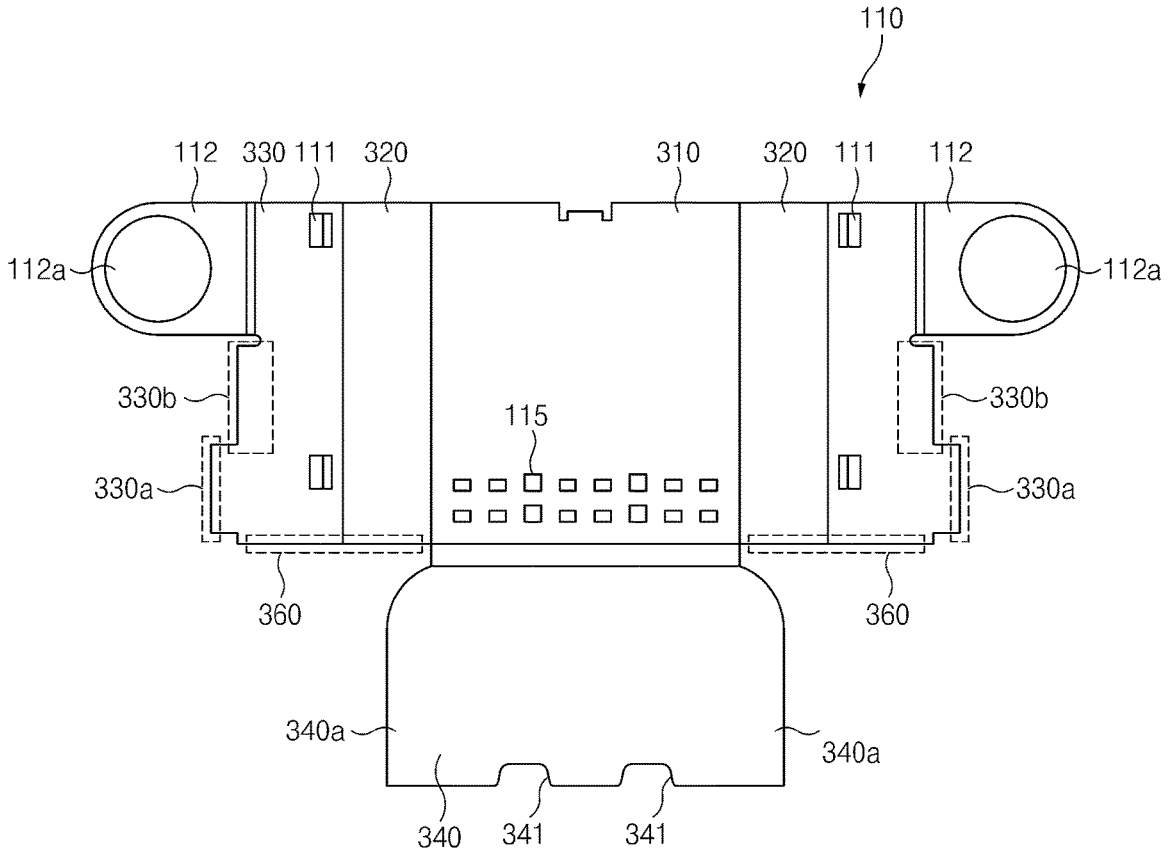
FIG. 3 is a view of an outer shell of the connector according to embodiments of the present disclosure.

FIG. 3 is a view of an outer shell of the connector according to embodiments of the present disclosure.

Referring to FIG. 3, the outer shell 110 includes a top area 310, bending areas 320, side areas 330, and a rear area 340.

Although the areas are classified in FIG. 3 for convenience of description, the outer shell 110 may be integrally formed of one material, such as by partially cutting one plate of a metal material and bending or coupling the remaining areas.

The top area 310 is coupled to the top surface of the inner shell 120 through at least one soldered part, and includes at least one hole 115. The hole 115 may be used to inspect the pins in the connector 101 by, the naked eye or to apply a resin to the designated pins for preventing corrosion, from the outside of the connector 101. Because the electromagnetic waves radiated to the outside of the connector 101 increases as the size of the hole 115 increases, the size of the hole 115 may be restricted to a designated value or less. Furthermore, the hole 115 may have various forms, such as a tetragonal shape, a rectangular shape, a circular shape, or an elliptical shape, according to a design or manufacturing environment. The bending areas 320 extend from the left and right sides of the top area 310, respectively, and are areas in which the plate is bent according to a designated curvature to correspond to the form of the inner shell 120.

The side areas 330 extend from the bending areas 320 and are perpendicular to a surface of the PCB 102. The side areas 330 include at least one coupling part 111 coupled to the inner shell 120.

The side areas 330 further include fixing parts 112 that are coupled to the PCB 102 through screws, for example. The fixing parts 112 include holes 112*a*. The form of the fixing parts 112 or of the holes 112*a* varies according to the material or manufacturing environment of the outer shell.

The side areas further include insertion parts 330*a* that are coupled to the PCB 102, are inserted into the hole of the PCB 102, and fix the outer shell 110 to the PCB 102.

The side areas 330 further include interruption parts 330*b* that prevent an aperture from being generated between the fixing part 112 and the insertion part 330*a*. The height of the interruption parts 330*b* may be determined in consideration of the thickness of the fixing part 112 (or the thickness of a metal plate that realizes the outer shell 110). The interruption part 330*b* is disposed at lower ends of the side areas to interrupt electromagnetic waves radiated from the interior of the connector 101.

Figure 4:
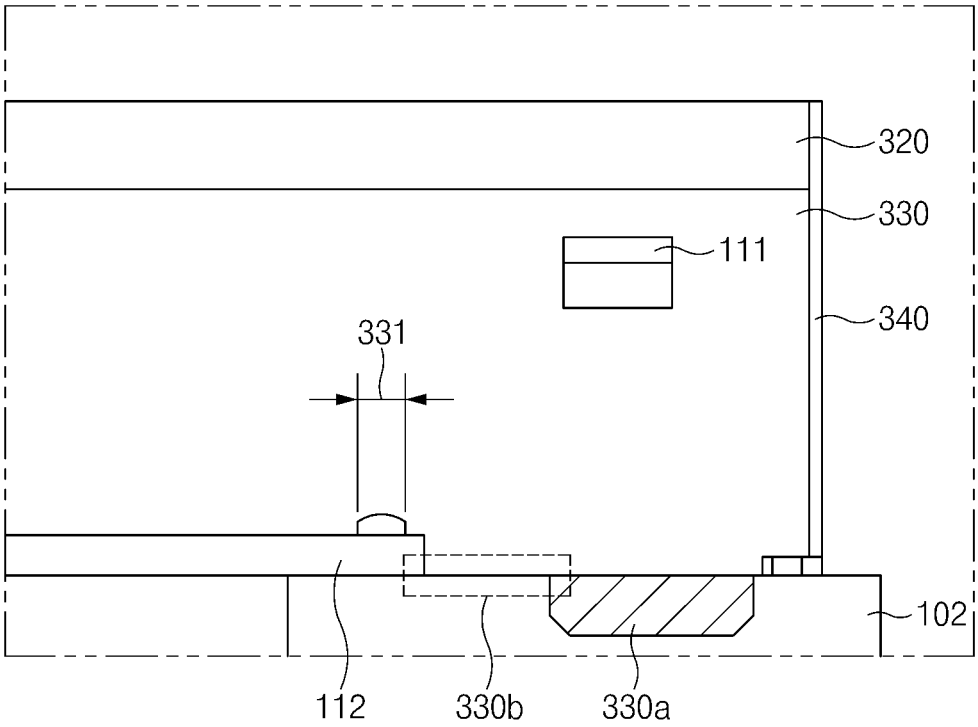
FIG. 4 illustrates side areas of an outer shell of the connector according to embodiments of the present disclosure.

The rear areas 340 extend rearwards from the top area 310 and contacts the bottom surface of the PCB 102 to be perpendicular to the bottom surface. The rear area 340 interrupts electromagnetic waves that are leaked to the rear side of the opened inner shell 120. The left and right side surfaces of the rear area 340 are coupled to ends of the bending areas 320 or the side areas 330. The rear area 340 includes at least one opening 341 which reduces an electrical influence between the rear area 340 and the pins 133*b* or 134*b*. FIG. 4 illustrates side areas of an outer shell of the connector according to embodiments of the present disclosure.

Referring to FIG. 4, when the outer shell 110 is connected to the PCB 102, the side areas 330 of the outer shell 110 may be implemented such that an unnecessary opening thereof is minimized for interrupting electromagnetic waves.

The side areas 330 may be fixed to the PCB 102 through the fixing parts 112 and the insertion parts 330*a*. The fixing parts 112 are coupled to the PCB 102 through screws, for example, and the insertion parts 330*a* are coupled to the PCB 102 in such a manner that the insertion parts 330*a* are inserted into the holes of the PCB 102. The insertion parts 330*a* fix the connector 101 while assisting the fixing parts 112.

The interruption parts 330*b* block the fixing parts 112 from the insertion parts 330*a* and are disposed to contact the PCB 102 so as to interrupt electromagnetic waves radiated from the interior of the connector 101.

According to embodiments, gaps 331 having a designated size are formed between the fixing parts 112 and the interruption parts 330*b*. The gaps 331 are spaces that are formed to facilitate deformation when the side areas 330 are manufactured by cutting or bending one metal plate. The gap 331 are implemented to have a width of about 0.25 millimeters (mm) or less. Because electromagnetic waves in the interior of the connector 101 may radiate even through the gap 331, it is necessary to minimize the size of the gap 331.

Figure 5:
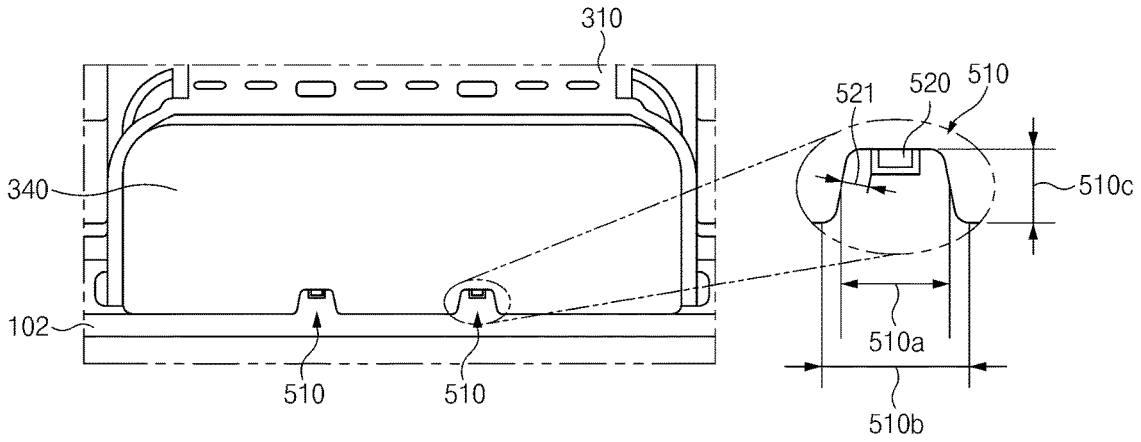
FIG. 5 illustrates a rear side area of a connector according to embodiments of the present disclosure.

FIG. 5 illustrates a rear side area of a connector according to embodiments of the present disclosure.

Referring to FIG. 5, the rear area 340 of the connector 110 interrupts electromagnetic waves irradiated to the rear side of the connector 110. The left and right side surfaces of the rear area 340 are coupled to the bending areas 320 extending to the left and right side surfaces of the connector 110 and ends of the side areas 330.

The rear area 340 includes openings 510 for reducing an influence on power pins 520. The openings 510 are areas for maintaining a designated distance between the rear area 340 and the power pins, such as V_Bus 520. When the power pins 520 have to maintain a designated distance from a peripheral metallic material or the ground while following standards, the openings 510 maintain at least the distance between the power pins 520 and the rear area 340.

As illustrated in FIG. 5, when the power pins 520 extend to the bottom surface of the connector 110 to be connected to the PCB 102, the openings 510 are disposed to contact a lower end of the rear area 340.

The width of the openings 510 increases when the openings 510 project towards the lower end of the rear area 340. The width 510*a*, such as 0.5 millimeters (mm), at upper or middle ends of the openings 510 is narrower than the width 510*b*, such as 0.6 mm, at lower ends of the openings 510. The height 510*c*, such as 0.3 mm, of the opening 510 may vary according to the locations of the power pins 520. The distance between the power pins 520 and the opening 510 is maintained at a designated value, such as at least 0.5 mm.

Figure 6:
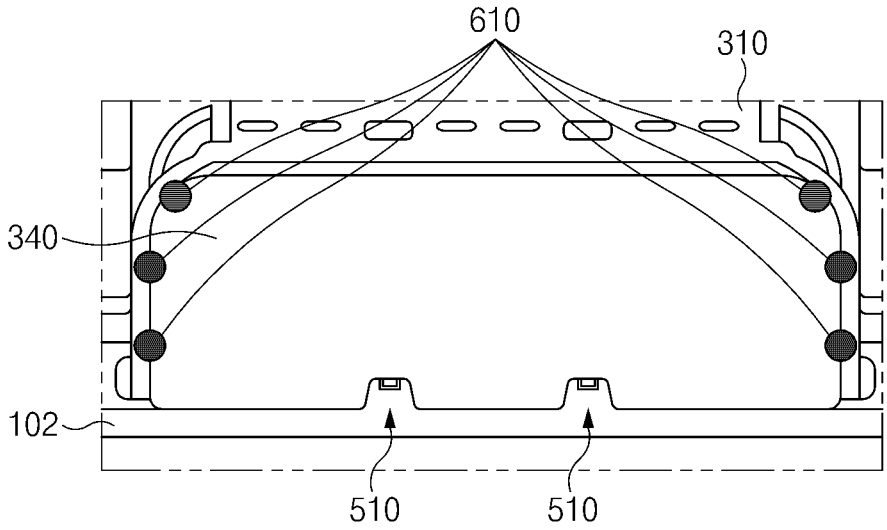
FIG. 6 illustrates a rear side area of a connector according to embodiments of the present disclosure.

FIG. 6 illustrates coupling points of a rear side area of a connector according to embodiments of the present disclosure;

Referring to FIG. 6, the rear area 340 of the connector 101 is coupled to ends of the bending areas 320 or the side areas 330 of the connector 101 through the coupling points 610, such as through laser welding at the coupling points 610. The coupling points 610 are disposed on the left and right side surfaces of the rear area 340 at a specific interval.

Although it is illustrated in FIG. 6 that three coupling points (a total of six coupling points) 610 are disposed on the left and right side surfaces of the rear area 340, respectively, the present disclosure is not limited thereto. For example, four coupling points (a total of eight points) 610 may be disposed on the left and right sides of the rear area 340, respectively, or two coupling points (a total of four coupling points) may be disposed, respectively. As the number of the coupling points 610 increases, the coupling force of the rear area 340 increases, which in turn increases electromagnetic wave interruption efficiency. However, as the number of the coupling points 610 increases, the number of processes and manufacturing costs of the connector 101 also may increase.

Figure 7:
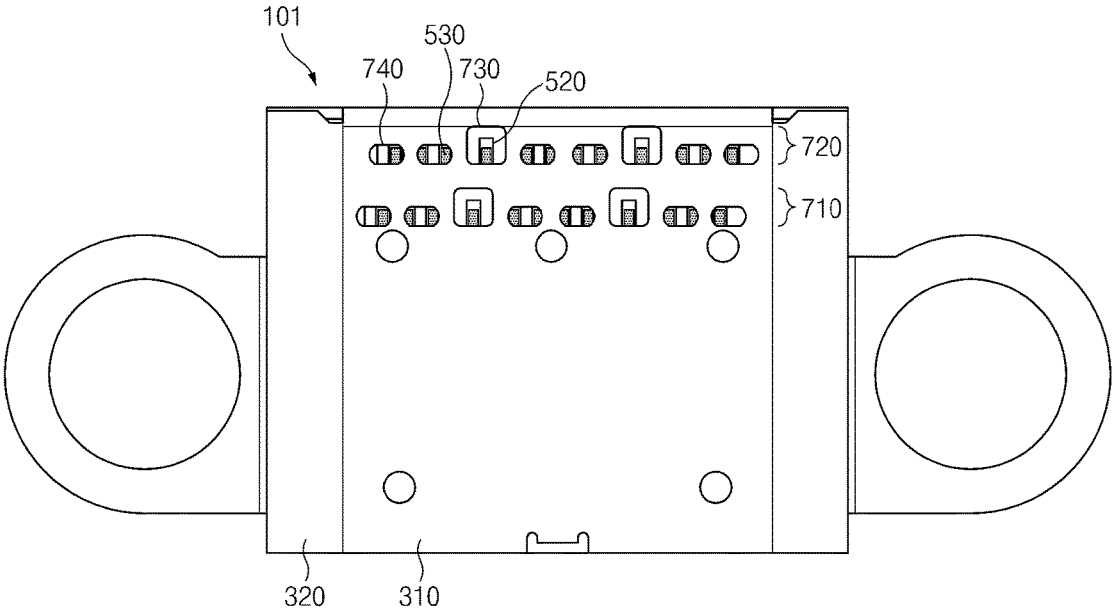
FIG. 7 illustrates holes formed in an outer shell of the connector according to embodiments of the present disclosure.

FIG. 7 illustrates holes formed in an outer shell of the connector according to embodiments of the present disclosure. The locations, the size, and the number of the holes of FIG. 7 are examples, and the present disclosure is not limited thereto.

Referring to FIG. 7, the holes 115 are disposed in the top area 310 of the outer shell 110 and are used to apply a resin to the designated pins, such as V_Bus, from the outside of the connector 101 in order to prevent corrosion due to moisture or to inspect the pins in the connector 101 by the naked eye from the outside of the connector 101.

Because the electromagnetic waves radiated to the outside of the connector 101 increases as the hole 115 increases, the size of the hole 115 is restricted to a designated value or less, and accordingly, the amount of electromagnetic waves leaked to the outside of the connector 101 is reduced.

The locations of the holes 115 varies according to the locations where the pins in the connector 101 are connected to the PCB 102. The holes include a first line of holes 710 and a second line of holes 720. The first line of holes 710 corresponds to the locations of the pins 133*b* connected to the first row of terminals 133 of FIG. 2, and the second line of holes 720 corresponds to the locations of the pins 134*b* connected to the second row of terminals 134.

The holes 115 include first holes 730 for applying a resin and second holes 740 for inspection by the naked eye.

The first holes 730 apply a resin to the power pins, such as V_Bus 520. The power pins 520 are vulnerable to peripheral moisture, and thus are protected from the moisture through application of a resin.

The method of applying a resin to the power pins 520 includes i) inserting a nozzle into the first holes 730 and applying a resin, or ii) injecting a resin around the first holes 730. The first holes 730 have a form or size that is necessary for a resin applying method used in the manufacturing process.

For example, in the method of inserting a nozzle and applying a resin, the first holes 730 have the same size as that of the inserted nozzle or the minimum size, such as 0.6 mm*0.6 mm, that allows passage of the nozzle. However, the minimum size varies according to the amount of electromagnetic waves generated, a design or manufacturing environment, and a data communication, and sizes of 0.6 mm*0.5 mm, 0.6 mm, or 0.4 mm may be implemented.

The second holes 740 are for visual inspection for identifying whether the pins are connected to the PCB 102. The second holes 740 may not be disposed to correspond to all the pins, and may be formed such that two or three pins are simultaneously identified.

Although it is illustrated in FIG. 7 that each of the second holes 740 is disposed between two general pins 530 such that two pins are identified simultaneously and has a rectangular form, such as 0.5 mm*0.3 mm, that extends to the left and right sides of the connector 101, the present disclosure is not limited thereto. The form or size of the first holes 740 varies according to a design or manufacturing environment. The size of the second holes 740 is smaller than the size of the first holes 730.

Figure 8A:
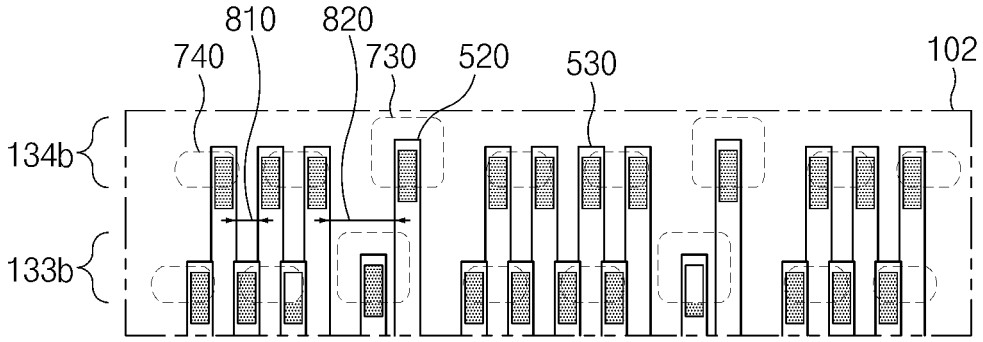
FIGS. 8A and 8B illustrate an arrangement view of pins in the interior of a connector according to embodiments of the present disclosure.
Figure 8B:
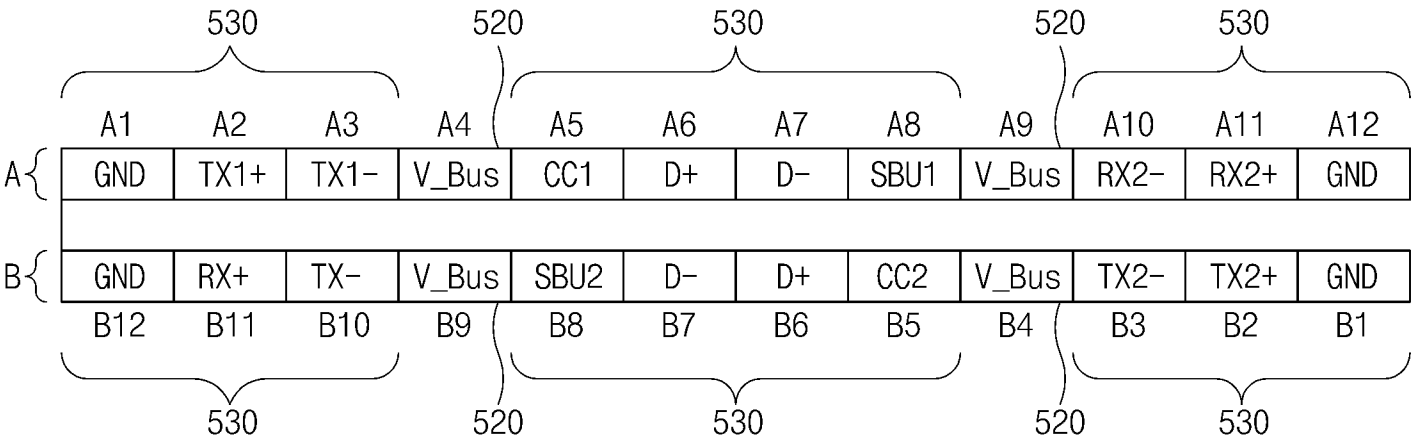

FIGS. 8A and 8B illustrate an arrangement view of pins in the interior of a connector according to embodiments of the present disclosure.

Referring to FIG. 8A, the pins connected to the terminal part 130 are connected to the PCB 102 behind the connector 101. Although arrangement of the pins that support the USB 3.1 Standard is illustrated in FIG. 8A, the present disclosure is not limited thereto.

A resin is applied to the power pins 520 through the first holes 730 to prevent corrosion by moisture. The power pins 520 are disposed to have sizes different from those of the general pins 530 or to be spaced apart from the general pins 530 by a designated distance or more.

The first distance 810 between the general pins 530 is less than the second distance 820 between the power pins 520 and the general pins 520, in which case a process of applying a resin to the power pins 520 is simplified.

The pins 133*b* are disposed to cross the pins 134*b*. Through this, the efficiency for disposition of the pins on the PCB 102 is enhanced, and an influence by other rows of pins is reduced when a resin is applied.

Referring to FIG. 8B, the connector 101 includes rows A and B of pins, and each of the rows includes twelve pins. Although arrangement of the pins that support the USB 3.1 Standard is illustrated in FIG. 8B, the present disclosure is not limited thereto.

Row A includes V_Bus pins (A4 and A9) as the power pins, and includes other general pins. A resin is applied to the V_Bus pins A4 and A9 through the holes 730.

Row A further includes USB 2.0 data pins (A6 and A7), a configuration channel pin (A5), transmit (Tx) and receive (Rx) pin pairs (A2, A3, A10, and A11), a sideband use pin A8, and ground pins A1 and A12 as the general pins 530.

Similarly, row B includes V_Bus pins (B4 and B9) as the power pins, and includes other general pins. A resin is applied to the V_Bus pins B4 and B9 through the holes 730.

Row B further includes USB 2.0 data pins (B6 and B7), a configuration channel pin (B5), transmit (Tx) and receive (Rx) pin pairs (B2, B3, B10, and B11), a sideband use pin B8, and ground pins B1 and B12 as the general pins 530.

Figure 9:
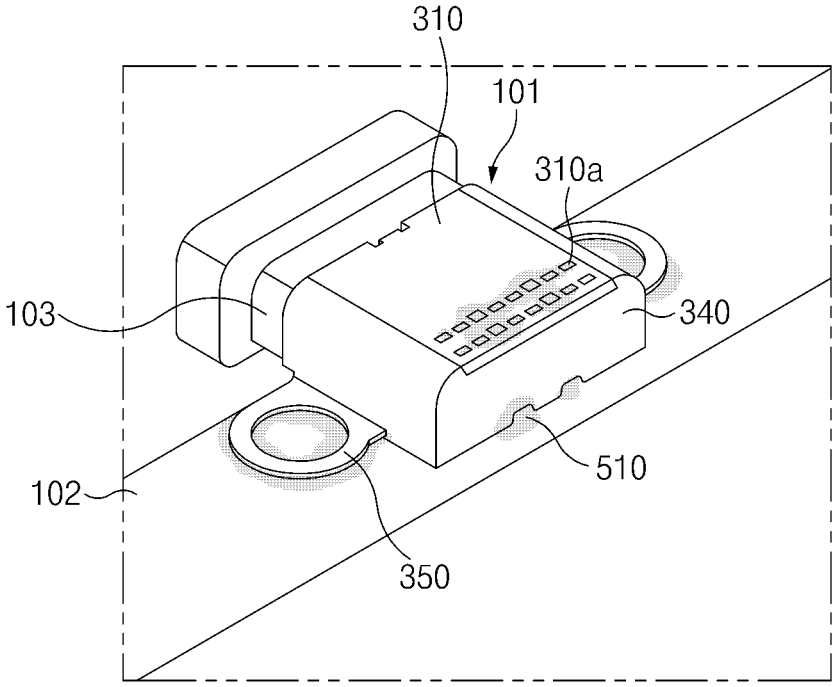
FIG. 9 illustrates irradiation of electromagnetic waves through a connector according to embodiments of the present disclosure.

FIG. 9 illustrates irradiation of electromagnetic waves through a connector according to embodiments of the present disclosure.

Referring to FIG. 9, when the plug 103 is inserted into the connector 101 and data is transmitted and received, electromagnetic waves are generated by a plurality of terminals. The electronic waves are primarily interrupted by the inner shell 120 and are secondarily interrupted by the outer shell 110. The connector 101 efficiently interrupts leakage of electromagnetic waves through the outer shell 110 and the inner shell 120.

As illustrated in FIG. 9, in the connector 101, some electromagnetic waves may be radiated from some opened areas, such as peripheral areas around the fixing parts 112, of the holes 310*a*, and of the openings 510 of the outer shell 110, but electromagnetic waves radiated from the other areas may be efficiently interrupted. Although the antenna radiation performance disposed around a connector decreases by electromagnetic waves generated by the connector because the outer shell 110 cannot interrupt electromagnetic waves according to the related art, the connector according to the present disclosure prevents degrading of the antenna radiation performance by efficiently interrupting electromagnetic waves leaked through the outer shell 110 and the inner shell 120. When the disposition direction of the connector 101 and the locations of openings and the like are determined in consideration of the location of an antenna for wireless communication, an influence by electromagnetic waves is efficiently reduced.

Figure 10:
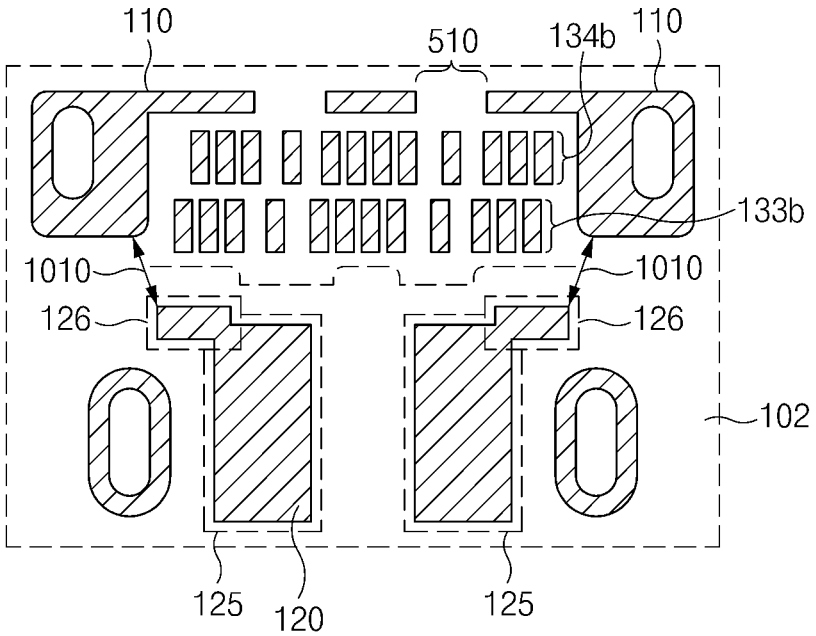
FIG. 10 illustrates a pad shape on a printed circuit board (PCB) according to embodiments of the present disclosure.

FIG. 10 illustrates a pad shape on a PCB according to embodiments of the present disclosure.

Referring to FIG. 10, various configurations, such as the inner shell 120, the outer shell 110, and the plurality of pins disposed on the bottom surface of the connector 101 may be connected to a surface of the PCB 102. The pins 133*b* and 134*b* are connected to the first row of terminals 133 and the second row of terminals 134, respectively, in FIG. 2. The pins 133*b* and 134*b* transfer designated electrical signals, respectively.

The inner shell 120 and the outer shell 110 are disposed around the pins 133*b* and 134*b* to interrupt electromagnetic waves that are generated by the pins.

The inner shell 120 is disposed on the front side (a side from which the plug 103 is inserted) of the pins 133*b* and the pins 134*b*, and the outer shell 110 is disposed on the lateral sides and the rear side of the pins 133*b* and the pins 134*b*.

The inner shell 120 includes a front pad area 125 and a side pad area 126 to be coupled to the PCB 102.

The front pad area 125 extends to the front or rear side of the connector 101, and allows the inner shell 120 to be firmly mounted on the PCB 102.

The side pad area 126 extends to the left and right sides of the connector 101, and is shielded to interrupt electromagnetic waves discharged towards the front side of the pins 133*b* and the pins 134*b*. As the side pad area 126 is expanded, the distance 1010 between the inner shell 120 and the outer shell 110 is additionally reduced and an electromagnetic wave interrupting function is reinforced. The distance 1010 between the inner shell 120 and the outer shell 110 varies according to a design or manufacturing environment thereof. For example, the distance 1010 may be manufactured to maintain a value of 0.6 mm or less.

Figure 11:
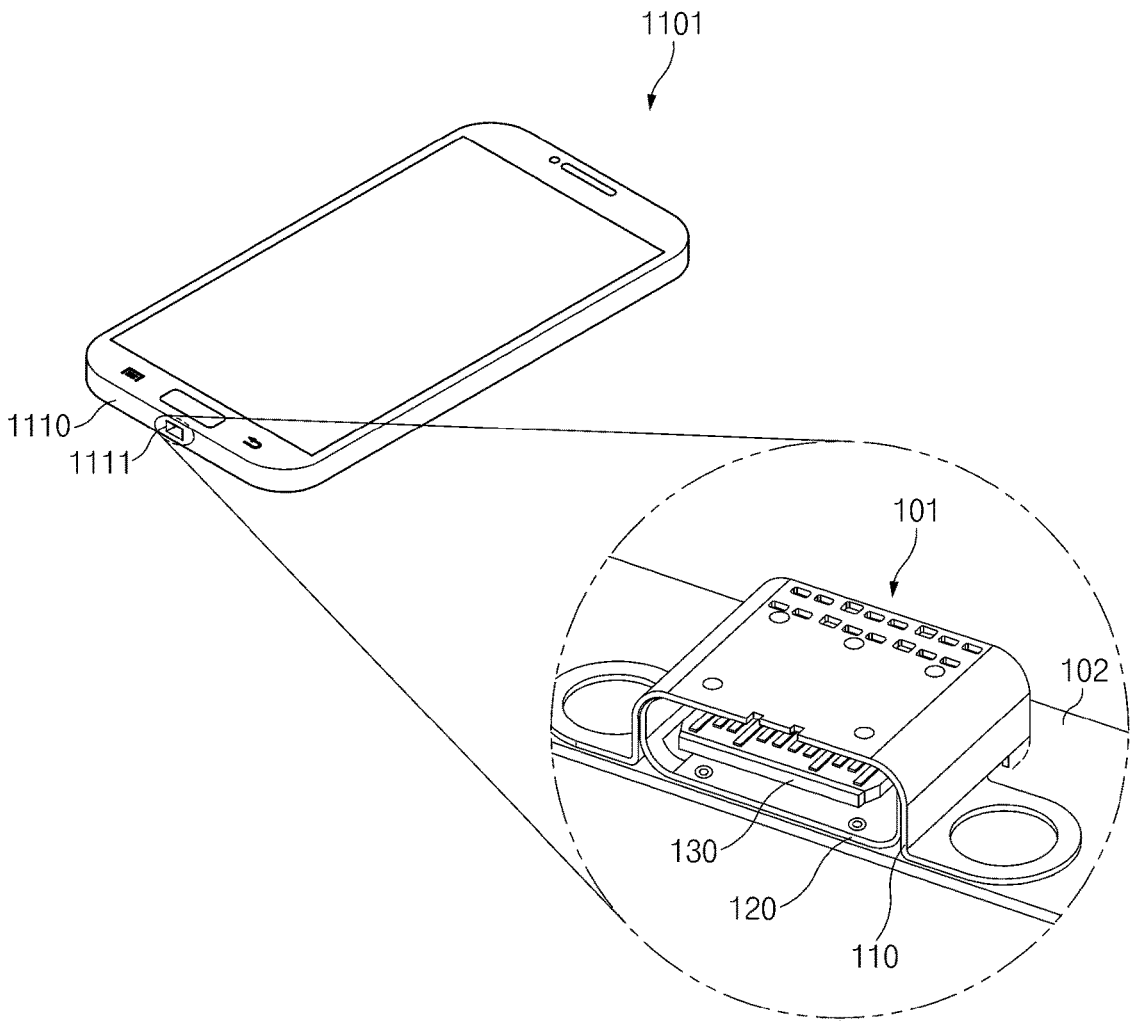
FIG. 11 illustrates an electronic device including a connector according to embodiments of the present disclosure.

FIG. 11 illustrates an electronic device including a connector according to embodiments of the present disclosure.

Referring to FIG. 11, the electronic device 1101 such as a smartphone or a tablet, performs various functions such as outputting of media, storage of data, and wireless communication. The electronic device 1101 transmits and receives data to and from an external device through the connector 101, and includes a housing 1110, an opening 1111, a connector 101, and a board 102.

A display, a home button, and a volume button are disposed outside the electronic device 1101, and the electronic device 1101 is surrounded by an outer case or an inner housing is partially exposed to the outside to form an external appearance of the electronic device 1101.

The housing 1110 fixes various modules or devices in the interior of the electronic device 101. A portion of the housing is exposed to the outside to form an external appearance of the electronic device 1101. Although it is mainly described herein that the housing is partially exposed to the outside, the present disclosure is not limited thereto, and a separate case could mounted to the outside of the housing.

The electronic device 1101 includes an opening 1111 formed on one surface of the housing 1110. The opening 1111 is connected to the connector 101, and is a movement passage of the plug inserted from the outside. The electronic device 1101 further includes a separate cover for protecting the opening 1111.

Although it is illustrated in FIG. 11 that the opening 1111 and the connector 101 are disposed at a lower end of the electronic device 111, the present disclosure is not limited thereto. For example, the opening 111 and the connector 101 may be disposed on left and right side surfaces or an upper end of the electronic device 1101.

The electronic device 1101 further includes a wireless communication module, such as an antenna disposed in the interior of the housing 1110 to transmit and receive a wireless signal of a designated frequency band and at least one processor electrically connected to the wireless communication module and the connector 101.

When the processor transmits and receives data through the connector 101 at a designated transmission rate, such as 10 gigabytes per second (Gbps), interference with the wireless signal is generated according to transmission and reception of data. The outer shell 110 and the inner shell 120 of the connector 101 prevent degrading of wireless communication performance by interrupting the interference. The transmission rate is a value selected from 9 Gbps to 11 Gbps.

Figure 12:
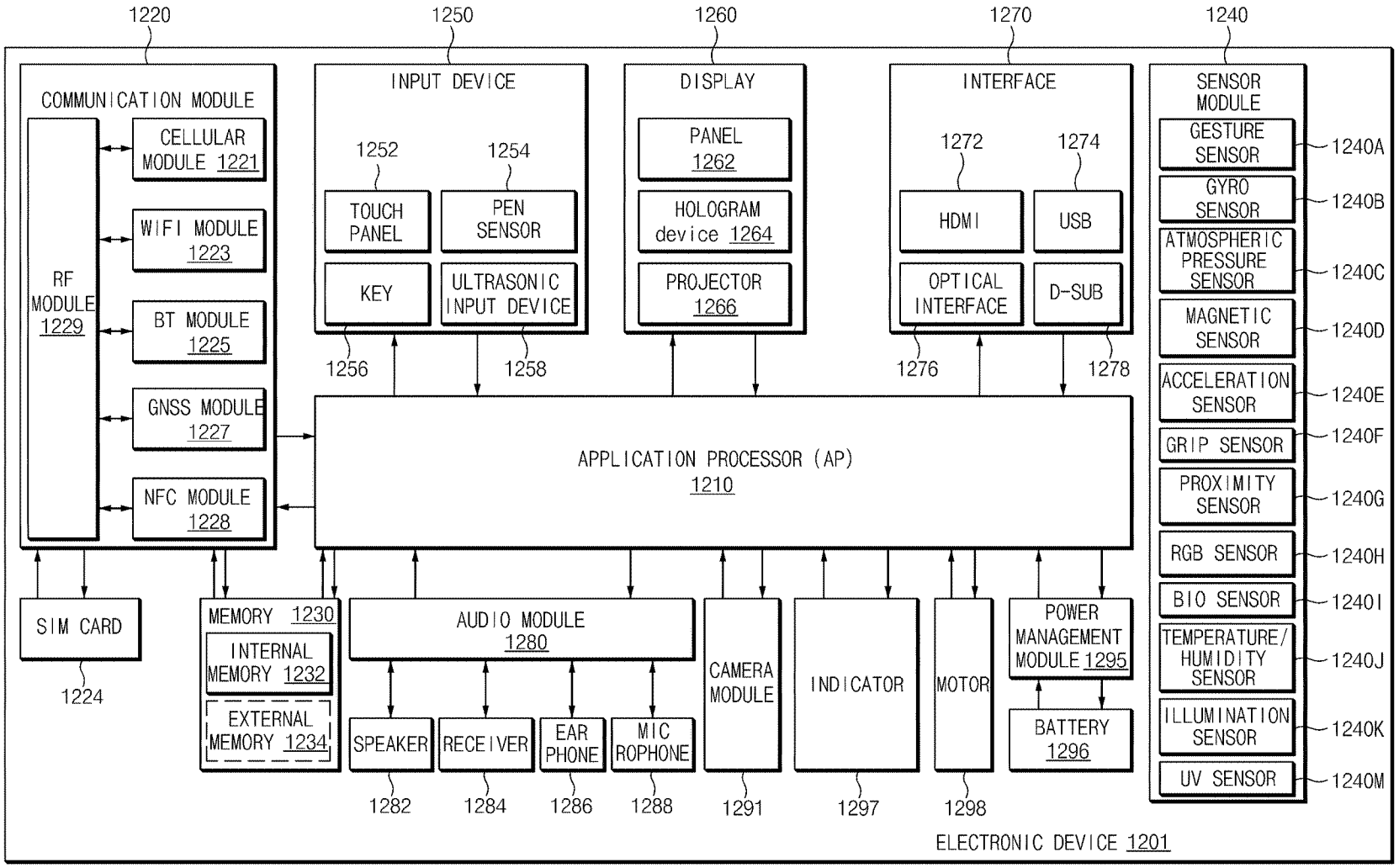
FIG. 12 is a block diagram of an electronic device according to embodiments of the present disclosure.

FIG. 12 is a block diagram of an electronic device 1201 according to embodiments of the present disclosure. Referring to FIG. 12, the electronic device 1201 includes at least one application processor (AP) 1210, a communication module 1220, a subscriber identification module (SIM) card 1224, a memory 1230, a sensor module 1240, an input device 1250, a display 1260, an interface 1270, an audio module 1280, a camera module 1291, a power management module 1295, a battery 1296, an indicator 1297, and a motor 1298. The interface 1270 includes the connector of FIGS. 1 to 8.

The processor 1210 controls a plurality of hardware or software components connected to the processor 1210 by driving an operating system or an application program and performs a variety of data processing and calculations. The processor 1210 may be implemented by a system on chip (SoC). According to an embodiment, the processor 1210 further includes a graphical processing unit (GPU) and/or an image signal processor, includes at least some of the components illustrated in FIG. 12, loads instructions or data, received from at least one other component, such as a non-volatile memory, in a volatile memory to process the loaded instructions or data, and stores various types of data in a non-volatile memory.

The communication module 1220 includes a cellular module 1221, a WiFi module 1223, a Bluetooth™ module (BT) 1225, and a GNSS module 1227, such as a global positioning system (GPS) module, a Glonass module, a Beidou module, or a Galileo module, a near field communication (NFC) module 1228, and a radio frequency (RF) module 1229.

The cellular module 1221 provides a voice call, a video call, a text message service, or an Internet service through a communication network. According to an embodiment, the cellular module 1221 distinguishes between and authenticate electronic devices 1201 within a communication network using the SIM card 1224, performs at least some of the functions that the processor 1210 provides, and includes a communication processor (CP).

The Wi-Fi module 1223, the BT module 1225, the GPS module 1227, and the NFC module 1228 include a processor for processing data transmitted/received through the corresponding module. According to some embodiments, at least two of the cellular module 1221, the WiFi module 1223, the Bluetooth module 1225, the GNSS module 1227, and the NFC module 1228 may be included in one integrated chip (IC) or IC package.

The RF module 1229 transmits/receives a communication signal, such as an RF signal, and includes a transceiver, a power amp module (PAM), a frequency filter, a low noise amplifier (LNA), or an antenna. According to another embodiment, at least one of the cellular module 1221, the WiFi module 1223, the Bluetooth module 1225, the GNSS module 1227, or the NFC module 1228 transmits and receives an RF signal through a separate RF module.

The SIM card 1224 includes may be an embedded SIM, and further includes unique identification information, such as an integrated circuit card identifier (ICCID), or subscriber information, such as international mobile subscriber identity (IMSI).

The memory 1230 includes an internal memory 1232 or an external memory 1234. The internal memory 1232 includes at least one of a volatile memory, such as a dynamic random access memory (DRAM), a static RAM (SRAM), and a synchronous dynamic RAM (SDRAM), and a non-volatile memory, such as a one time programmable read only Memory (OTPROM), a programmable ROM (PROM), an erasable and programmable ROM (EPROM), an electrically erasable and programmable ROM (EEPROM), a flash memory, such as a NAND flash memory or a NOR flash memory), a hard driver, and a solid state drive (SSD).

The external memory 1234 further includes a flash drive such as a compact flash (CF), a secure digital (SD), a micro secure digital (Micro-SD), a Mini-SD, an eXtreme digital (xD), or a memory stick. The external memory 1234 may be functionally and/or physically connected to the electronic device 1201 through various interfaces.

The sensor module 1240 measures a physical quantity or detect an operation state of the electronic device 1201, and converts the measured or detected information to an electrical signal. The sensor module 1240 includes at least one of a gesture sensor 1,240A, a gyro sensor 1,240B, an atmospheric pressure sensor 240C, a magnetic sensor 240D, an acceleration sensor 240E, a grip sensor 240F, a proximity sensor 240G, a color sensor 240H, such as a red, green, and blue (RGB) sensor, a biometric sensor 240I, a temperature/humidity sensor 1,240J, an illumination sensor 1,240K, and a Ultra Violet (UV) sensor 240M. Additionally or alternatively, the sensor module 1240 includes an E-nose sensor, an electromyography (EMG) sensor, an electroencephalogram (EEG) sensor, an electrocardiogram (ECG) sensor, an infrared (IR) sensor, an iris sensor, and/or a fingerprint sensor.

The sensor module 1240 further includes a control circuit for controlling one or more sensors included therein. In some embodiments, the electronic device 1201 further includes a processor that controls the sensor module 1240 as a part of or separately from the processor 1210, and controls the sensor module 1240 while the processor 1210 is in a sleep state.

The input device 1250 includes a touch panel 1252, a (digital) pen sensor 1254, a key 1256, or an ultrasonic input device 1258. The touch panel 1252 uses at least one of a capacitive type, a resistive type, an infrared type, and an ultrasonic type. The touch panel 1252 further includes a control circuit and a tactile layer which provides a tactile reaction to a user.

The (digital) pen sensor 1254 includes a recognition sheet which is a part of the touch panel or a separate recognition sheet. The key 1256 includes a physical button, an optical key, or a keypad. The ultrasonic input device 1258 detects ultrasonic waves generated by an input tool through a microphone 1288 and identifies data corresponding to the detected ultrasonic waves.

The display 1260 includes a panel 1262, a hologram 1264, or a projector 1266. The panel 1262 may be implemented to be flexible, transparent, or wearable, and is formed as a single module together with the touch panel 1252. The hologram device 1264 displays a three dimensional image in the air using interference of light. The projector 1266 displays an image by projecting light onto a screen, which is located in the interior of or on the exterior of the electronic device 1201. According to an embodiment, the display 1260 further includes a control circuit for controlling the panel 1262, the hologram device 1264, or the projector 1266.

The interface 1270 includes a high-definition multimedia interface (HDMI) 1272, a universal serial bus (USB) 1274, an optical interface 1276, and a D-subminiature (D-sub) 1278. Additionally or alternatively, the interface 1270 includes a mobile high-definition link (MHL) interface, a SD card/multi-media card (MMC) interface, or an infrared data association (IrDA) standard interface.

The audio module 1280 bilaterally converts a sound and an electrical signal, and processes voice information input or output through a speaker 1282, a receiver 1284, earphones 1286, or the microphone 1288.

The camera module 1291 photographs a still image and a dynamic image, and includes one or more image sensors, such as a front or back sensor, a lens, an image signal processor (ISP) and a flash, such as a light-emitting diode (LED) or xenon lamp.

The power management module 1295 manages power of the electronic device 1201, and includes a power management integrated circuit (PMIC), a charger integrated circuit (IC), or a battery gauge. The PMIC has a wired and/or wireless charging scheme. Examples of the wireless charging method include a magnetic resonance method, a magnetic induction method, and an electromagnetic wave method. Additional circuits, such as a coil loop, a resonance circuit, and a rectifier, for wireless charging may be further included. The battery gauge measures a residual quantity of the battery 1296, and a voltage, a current, or a temperature while charging, and includes a rechargeable battery and/or a solar battery.

The indicator 1297 indicates a particular status of the electronic device 1201 or a part thereof a booting status, a message status, or a charging status, for example. The motor 1298 converts an electrical signal into mechanical vibrations, and generates a vibration or haptic effect. The electronic device 1201 includes a processing device, such as a GPU, for supporting mobile TV. The processing unit processes media data pursuant to a certain standard of digital multimedia broadcasting (DMB), digital video broadcasting (DVB), or media flow (mdiaFlo™).

Each of the elements described in the specification includes one or more components, and the terms of the elements may be changed according to the type of the electronic device. In embodiments of the present disclosure, the electronic device includes at least one of the elements described in the specification, and some elements may be omitted or additional elements may be further included. Some of the elements of the electronic device according to embodiments are coupled to form one entity, and perform the same functions of the corresponding elements before they are coupled.

The connector according to embodiments includes a terminal part, an inner shell surrounding the terminal part and having a plug form inserted from the outside, and an outer shell surrounding at least a portion of the inner shell to interrupt electromagnetic waves generated as data is transmitted and received through the terminal part.

The outer shell includes a top area, bending areas extending from the top area to left and right side surfaces thereof, side areas extending from the bending areas and being perpendicular to a bottom surface thereof, and a rear area disposed on an opposite side to a surface, through which the plug is inserted, and being perpendicular to the bottom surface. The top area, the bending areas, the side areas, and the rear area may be integrally formed of one metallic material. The bending areas may be bent and adhered to an outer surface of the inner shell.

The side areas include at least one coupling part that is coupled to the inner shell and an insertion part that is inserted into a hole formed in a PCB. The side areas further include a fixing part that couples the outer shell to a PCB, and an interruption part that is disposed adjacent to the fixing part and contacts a surface of the PCB.

The rear area includes at least one opening for maintaining a specific distance or more from a designated pin connected to the terminal part. The opening is disposed between a lower end of the rear area and a surface of the PCB. The opening increases as towards the lower end of the rear area.

The rear area is coupled to ends of the bending areas and the side areas through a designated number or more of coupling points.

The inner shell has a form corresponding to the plug, and the top area, the bending areas, and the side areas are disposed to be adhered to a surface of the inner shell. The terminal part includes a plurality of terminals based on the USB 3.1 Standard.

The outer shell includes at least one hole through which the pin connected to the terminal part is approached. The hole includes a first hole for applying a resin to the pin, and a second hole for identifying connection of the pin and a board, on which the connector is mounted. The first hole is disposed at a location where a power pin of the pins is connected the board. The first hole has a size or a form corresponding to the size or form of a nozzle that applies a resin to the power pin.

The hole is disposed such that a first line and a second line including at least one first hole and at least one second hole are formed, and the first hole is disposed between the second holes in the first line and the second line.

The size of the first hole may be larger than the size of the second hole. The number of the second holes is less than the number of the general pins except for the power pin. The centers of the second holes are disposed between the general pins except for the power pin.

The electronic device according to embodiments includes a connector, and the connector includes a terminal part, an inner shell surrounding the terminal part and having a plug form inserted from the outside, and an outer shell surrounding at least a portion of the inner shell.

The electronic device according to embodiments includes a housing, an opening formed on a surface of the housing, a board disposed in the housing to be substantially perpendicular to the surface of the housing, and a connector connected through the opening and mounted on the board, and the connector includes a designated number or more of pins connected to or mounted on the board, an inner shell surrounding the pins from at least three sides, and an outer shell surrounding at least a portion of an outer surface of the inner shell. Three or more pins may be provided. The inner shell surrounds at least three sides of the pins around the opening, when viewed from the top of one surface of the housing.

The electronic device according to embodiments further includes a wireless communication module disposed in the interior of the housing to transmit and receive a wireless signal of a designated frequency band, and at least one processor connected to the wireless communication module and the connector. When the processor transmits and receives data through at least one of the pins at a designated transmission rate, the inner shell or the outer shell interrupts interference with the wireless signal. The transmission rate is selected from 9 Gbps to 11 Gbps.

The electronic device according to embodiments includes a first metal pad mounted on the board and a second metal pad spaced apart from the first metal pad by a first distance, at least one periphery of the inner shell or the outer shell may make electrical contact with the first metal pad and the second metal pad, and the first distance may be a designated value or less.

The term "module" used in the specification indicates a unit including one or at least two of hardware, software, and firmware. The module may be interchangeably used with a unit, a logic, a logical block, a component, or a circuit. The module may be a minimum unit or a part of an integrally configured part. The module may be a minimum unit or a part which performs one or more functions. The module may be implemented mechanically or electromagnetically. For example, the module may include at least one of an application-specific integrated circuit (ASIC) chip, a field-programmable gate array, or a programmable-logic device, which is known or will be developed in the future.

The connector according to embodiments of the present disclosure efficiently interrupts electromagnetic waves generated in the terminals through the separate outer shell that is distinguished from the inner shell.

The electronic device including the connector according to embodiments of the present disclosure prevents degradation of an antenna radiation performance by interrupting electromagnetic waves that influences a wireless communication antenna disposed around the connector.

The embodiments disclosed in the specification are provided to describe the technical contents or for understanding of the technical contents, and the technical scope of the present disclosure is not limited thereto. Accordingly, the scope of the present disclosure should be construed to include all changes or embodiments based on the technical spirit of the present disclosure.

While the present disclosure has been shown and described with reference to certain embodiments thereof, it will be understood by those skilled in the art that various changes in form and details may be made therein without departing from the spirit and scope of the present disclosure as defined by the appended claims and their equivalents.

What is claimed is:

1. A connector comprising:

a terminal part including a first pin for power supply and a second pin for data transmission;

an inner shell surrounding the terminal part and having a form corresponding to a plug that is inserted into the connector from outside of the connector; and an outer shell surrounding at least a portion of the inner shell, wherein the first pin is at least partially coated with a resin to prevent corrosion, wherein the outer shell is provided with a plurality of first holes through which the first pin is accessible and a plurality of second holes through which the second pin is accessible, wherein the resin is applied to the first pin through at least one of the first holes, and wherein each of the first holes is larger than each of the second holes, and the first holes are fewer in number than the second holes, wherein each of the first holes is formed between the second holes, and wherein the first holes and the second holes are formed to enable seeing through the first holes and the second holes to identify that the first pin and the second pin are connected to a board.

2. The connector of claim 1, wherein the outer shell comprises:

a top area;

bending areas extending from the top area to left and right side surfaces of the outer shell;

side areas extending from the bending areas and being perpendicular to a bottom surface of the outer shell; and a rear area disposed on an opposite side to a surface, through which the plug is inserted, and being perpendicular to the bottom surface.

3. The connector of claim 2, wherein the top area, the bending areas, the side areas, and the rear area are integrally formed of one metallic material.

4. The connector of claim 2, wherein the bending areas are bent and adhered to an outer surface of the inner shell.

5. The connector of claim 2, wherein the side areas comprise at least one coupling part that is coupled to the inner shell.

6. The connector of claim 2, wherein the side areas comprise an insertion part that is inserted into a hole formed in a printed circuit board (PCB).

7. The connector of claim 2, wherein the side areas further comprise a fixing part that couples the outer shell to a printed circuit board (PCB).

8. The connector of claim 7, wherein the side areas further comprise interruption parts that are disposed adjacent to the fixing part and contact a surface of the PCB.

9. The connector of claim 2, wherein the rear area comprises at least one opening for maintaining a specific distance or more from a designated pin connected to the terminal part.

10. The connector of claim 9, wherein the opening is disposed between a lower end of the rear area and a surface of the PCB.

11. The connector of claim 9, wherein the opening becomes wider towards the lower end of the rear area.

12. The connector of claim 2, wherein the rear area is coupled to ends of the bending areas and the side areas through a designated number or more of coupling points.

13. An electronic device comprising:

a housing;

an opening formed on a surface of the housing;

a board disposed in the housing to be substantially perpendicular to the surface of the housing; and a connector connected through the opening and mounted on the board, wherein the connector comprises:

a designated number or more of pins connected to or mounted on the board;

an inner shell surrounding the pins from at least three sides; and an outer shell surrounding at least a portion of an outer surface of the inner shell, wherein at least one hole is provided on the outer shell such that at least one pin disposed on the connector is accessible through the at least one hole, wherein the at least one hole is positioned on a surface of the outer shell that is perpendicular to a plane on which the at least one pin projects, wherein some of the designated number or more of pins are at least partially covered by a resin, wherein the at least one hole includes a plurality of first holes formed so that a nozzle for applying the resin can be inserted into the first holes, and a plurality of second holes for enabling visual inspection of the designated number or more of pins and the board, wherein the first holes are larger in size but fewer in number than the second holes, wherein each of the first holes is formed between the second holes, and wherein the first holes and the second holes are formed to enable seeing through the first holes and the second holes to identify that the first pin and the second pin are connected to a board.

14. The electronic device of claim 13, wherein the inner shell surrounds at least three sides of the pins around the opening, when viewed from above one surface of the housing.

15. The electronic device of claim 13, further comprising:

a wireless communication module disposed inside the housing to transmit and receive a wireless signal of a designated frequency band; and at least one processor connected to the wireless communication module and the connector.

16. The electronic device of claim 15, wherein when the at least one processor transmits and receives data through at least one of the pins at a designated transmission rate, the inner shell or the outer shell interrupts interference with the wireless signal.

17. The electronic device of claim 16, wherein the transmission rate is a value selected from 9 gigabytes per second (Gbps) to 11 Gbps.

* * * * *